United States Patent [19]

Uno

[11] 4,389,591

[45] Jun. 21, 1983

[54] IMAGE STORAGE TARGET AND IMAGE PICK-UP AND STORAGE TUBE

[75] Inventor: Yoshihiro Uno, Kawasaki, Japan

[73] Assignee: Matsushita Electric Industrial Company, Limited, Osaka, Japan

[21] Appl. No.: 111,308

[22] Filed: Jan. 11, 1980

Related U.S. Application Data

[63] Continuation of Ser. No. 876,061, Feb. 8, 1978, abandoned, which is a continuation-in-part of Ser. No. 623,013, Oct. 16, 1975, abandoned.

[51] Int. Cl.[3] ..... H01J 31/58

[52] U.S. Cl. ..... 313/391; 313/395

[58] Field of Search ..... 313/366, 367, 391, 392, 313/395

[56] References Cited

U.S. PATENT DOCUMENTS

| | | | |
|---|---|---|---|
| 3,002,124 | 9/1961 | Schneeberger | 315/12 |
| 3,339,099 | 8/1967 | Anderson | 313/398 |
| 3,548,233 | 12/1970 | Cave et al. | 313/367 |
| 3,631,294 | 12/1971 | Hofstein | 315/12 |
| 3,670,198 | 6/1972 | Lehovec et al. | 315/11 |
| 3,691,533 | 9/1972 | Bogenberger et al. | 313/391 X |
| 3,737,715 | 6/1973 | Silver | 313/391 X |
| 3,793,571 | 2/1974 | Janssen | 317/235 R |
| 3,805,126 | 4/1974 | Frobenius | 317/235 R |
| 3,940,651 | 2/1976 | Hofstein | 313/391 |
| 3,940,652 | 2/1976 | Picker | 313/401 |
| 3,949,264 | 4/1976 | Hofstein | 313/391 X |
| 4,185,227 | 1/1980 | Morris | 313/395 X |

FOREIGN PATENT DOCUMENTS

| | | | |
|---|---|---|---|
| 2262749 | 6/1973 | Fed. Rep. of Germany | 313/366 |
| 2260185 | 8/1975 | France | 313/366 |

*Primary Examiner*—Robert Segal

*Attorney, Agent, or Firm*—Robert E. Burns; Emmanuel J. Lobato; Bruce L. Adams

[57] ABSTRACT

A charge storage target of cathode ray electron devices comprises a conductive layer and a resistive layer having a common interface therewith, and an insulative layer. At least one of the layers has perforations so that only the resistive and insulative layers are exposed to electron impingement. The perforations define a plurality of elemental regions on which elemental electron image is stored. The resistive regions that cover the underlying conductive layer serve as buffer areas for the entering electrons of which the magnitude is proportional to the amount of charges deposited on the exposed insulative regions, and transfer the stored energy to the underlying layer.

4 Claims, 11 Drawing Figures

IMAGE STORAGE TARGET AND IMAGE PICK-UP AND STORAGE TUBE

CROSS REFERENCE TO RELATED APPLICATION

This is a Continuation Application of application Ser. No. 876,061, filed Feb. 8, 1978 which is a continuation-in-part application of application Ser. No. 623,013 filed Oct. 16, 1975, both now abandoned.

BACKGROUND OF THE INVENTION

The present invention relates to charge storage cathode ray electron devices, and more particularly to an improvement to the charge storage target of the device.

Prior art charge storage targets comprise a conductive layer and a perforated insulative layer in contact with the conductive layer. During writing operation, an intensity-modulated electron beam is permitted to impinge upon the surface of the insulative layer as well as the underlying conductive layer. As a result negative charges are accumulated on the insulative layer to form an electron image. During reading operation, an unmodulated electron beam scans across the target face. Because of the action of the negative surface potential on the insulative layer, the path of impinging electron beam is deflected as a function of the amount of charges on the insulative layer so that the electrons that impinge on the underlying conductive layer is intensity modulated by the negative surface potential, resulting in generation of a video signal from the conductive layer. Because of the direct impingement of electrons on the conductive layer, the operating characteristic of the prior art charge storage target, as illustrated in FIG. 1, has a small range of negative surface potentials at the insulative layer for a given range of video output currents. This means that for a given amount of output current variations, the available range of surface potential variations is limited and as a result gradual shading of image, or gradation is difficult to achieve. Furthermore, a surface noise on the insulative layer would produce a signal-to-noise ratio of comparatively small value, typically as high as 20 dB for a surface noise of 0.1 volts.

SUMMARY OF THE INVENTION

The principal object of the invention is to provide an improved charge storage target for cathode ray electron devices which is capable of providing a wide range of potential variations on the surface of insulative layer in order to achieve gradual shading of an image.

Another object of the invention is to provide an improved charge storage target which is characterized by a high signal-to-noise ratio.

These objects are achieved by the provision of a resistive layer disposed to have a common interface with the conductive layer which serves as the signal extraction electrode. In one embodiment, a perforated insulative layer is disposed over the resistive layer to expose portions of the underlying resistive layer to the impingement of an electron beam. The resistivity of the resistive layer is selected at a value which imparts a time constant to the target, in the direction of the electron beam, which is greater than a time period required for the electron beam to read an image stored on one picture element defined by each of the perforated areas and smaller than a time period between successive reading operations. During writing operation, an intensity-modulated electron beam is scanned across the entire surface of the target so that an electron image is deposited on the insulative layer. Since the insulative layer has a much higher resistivity than the resistive layer, and hence a longer charge holding time than the latter, the charge pattern can be nondestructively read out in response to electron impingement during succeeding reading operations.

During reading operations, the target is scanned by an unmodulated electron beam with the conductive layer being held at a given positive potential, typically at 14 volts. Because of the negative surface charges deposited on the insulative regions, the impinging electrons enter the exposed underlying resistive areas, the amount of such entering electrons being inversely proportional to the negative charges on the adjacent insulative regions. The resistive regions, which isolate the conductive layer from direct electron impingement, serve as buffer areas for the entering electrons so as to restrict the amount of such entering electrons to a limited value. The impingement of electrons on the resistive areas causes that portion of the conductive layer that underlies the exposed resistive areas to be automatically driven to a lower positive potential, typically 5 volts, whereby the operating curves of the target constructed according to the invention are tilted so that the curves have a gradual slope. This results in a greater range of surface potentials at the insulative layer for a given range of output currents, and hence, an improvement in gradation as well as in noise immunity capability.

BRIEF DESCRIPTION OF THE DRAWINGS

The invention will be further discussed in the following detailed description with reference to the accompanying drawings, in which.

DETAILED DESCRIPTION

Figure 2:
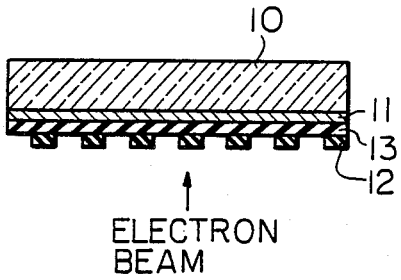
FIG. 2 is a cross-sectional view of the charge storage target in a preferred embodiment of the invention.

The charge storage target according to the invention represented in FIG. 2 comprises a conductive layer 11 shown attached to the inside of a faceplace 10 of a cathode-ray electron device, a resistive layer 13 having a common interface with the conductive layer 11 and an insulative layer 12 having perforations to permit electrons to pass therethrough to the underlying layer. The resistive layer 13 is formed of a material such as $Sb_2S_3$ whose resistance remains unchanged in the presense of electric fields. In practical embodiment, the resistive layer 13 is deposited through the use of vacuum evaporation technique or sputtering technique.

Figure 3:
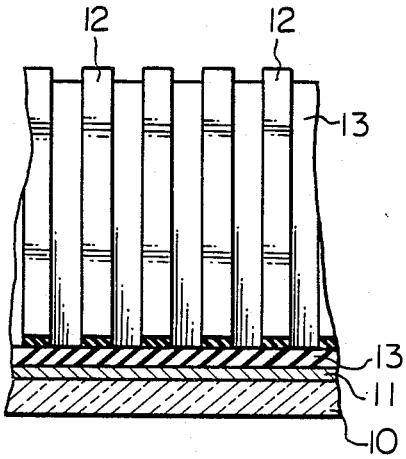
FIGS. 3 to 5 are plan views showing various modifications of the pattern of perforations on the target surface.
Figure 4:
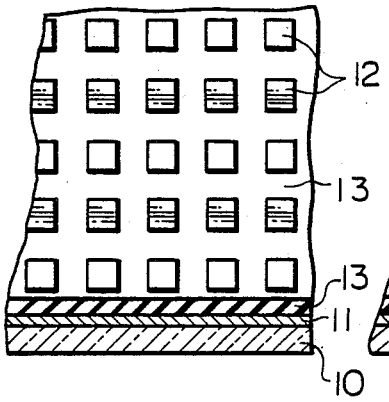
Figure 5:
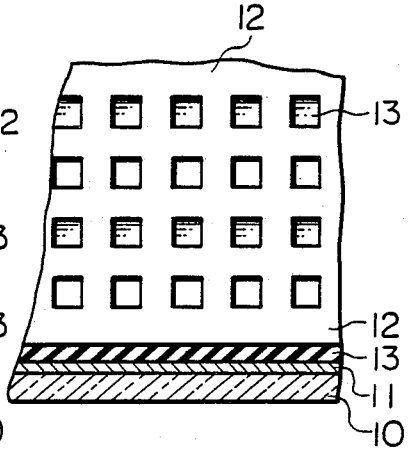

The pattern of perforations in the insulative layer 12 may be of striped configuration or a meshed form as shown in FIGS. 3 and 5, or in the form of isolated regions as illustrated in FIG. 4. In the case of the striped pattern as shown in FIG. 3, the width of each insulative striped region 12 ranges from 5 to 50 micrometers and the spacing between adjacent insulative strips ranges from 2 to 25 micrometers. These are preferred values for an electron tube with the faceplate measuring 1 inch in diagonal dimensions.

In the case of isolated pattern of insulation (FIG. 4), each isolated region 12 is not necessarily square-shaped, but may also be circular shaped. In the latter case, the diameter of each region 12 ranges from about 5 to 50 micrometers and the total area of the insulated regions is $\frac{1}{8}$ to 8 times the total area of the underlying exposed areas of the resistive layer 13, of which the preferred value being 1, that is both insulative and exposed underlying regions have equal total areas.

The insulative layer is preferably formed of a metal oxide such as $SiO_2$, or $Al_2O_3$, or an alkali halide such as NaCl or KCl, or an alkaline earth metal halide such as $CaF_2$, $MgF_2$ or glass.

Figure 6:
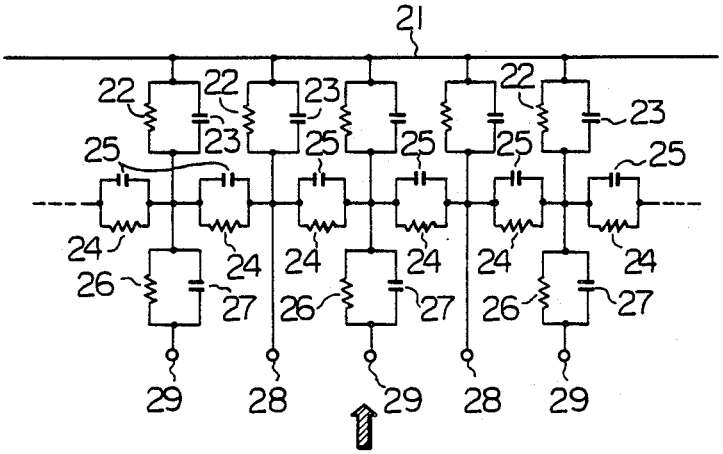
FIG. 6 is an equivalent circuit of the target structure according to the invention.

In the equivalent circuit representation of FIG. 6, a line 21 represents the conductive layer 11 and each set of resistor 22 and capacitor 23 in a parallel circuit represents the equivalent resistance and capacitance respectively of the portion of the resistive layer 13 that corresponds to each picture element in a direction parallel to the direction of electron beam indicated by the shaded arrow. A set of resistance 24 and capacitance 25 in parallel connection represent respectively the equivalent resistance and capacitance of the portion of resistive layer 13 that corresponds to each picture element in a direction normal to the direction of the electron beam. Each resistance-capacitance pair representing the lateral equivalent circuit is connected in a series circuit with the other pair of similar components and also connected to each resistance-capacitance pair representing the longitudinal equivalent circuit. Each of the insulative regions 12 is represented by a parallel connection of resistance 26 and capacitance 27 which are in turn connected to the junction of the equivalent circuits 22, 23 and 24, 25 so that the equivalent circuit 26, 27 is connected in a series circuit with the equivalent circuit 22, 23 of the portion of the resistive layer 13 that underlies the insulative region 12. The unoccupied areas or perforations in the insulative layer 12 allow the electron beam access to the exposed areas of the resistive layer 12, so that the exposed areas of the resistive layer can be considered as being connected to terminals 28, while the unexposed areas are connected to terminals 29 via resistors 25 and capacitors 26. Therefore, the resistors and capacitors connected to a terminal 28 and those connected to a terminal 29 can be considered to constitute a single picture element on which an elemental electron image is to be stored and retrieved therefrom. More specifically, the elemental electron image is stored on capacitor 27 and this electron image is read through the circuit formed by capacitor 23 and resistor 22 as will be described hereinbelow. For practical purposes, the lateral equivalent circuits formed by resistances 24 and capacitances 25 is not necessary to take into account because of their relatively small values to the component values of the longitudinal equivalent circuits.

During writing operation, the source of cathoderay beam is maintained at zero potential level and the conductive layer 11 is held at a positive of 14 volts. Under these conditions, the target surface is scanned by an unmodulated electron beam of a sufficiently high intensity. Since the charge storage capability of the target depends on the resistivity of the material that constitutes the beam impingement side of the target, the insulative regions 12 stores negative charges much greater than the charges stored on the resistive layer 13, so that the surface potential of the insulative areas is uniformly reduced to a zero potential level. Subsequently, the conductive layer 11 is raised to +26 volts, resulting in the surface potential of the insulative regions 12 acquiring a positive potential of 12 volts, that is, the terminal 29 is biased to +12 volts.

Under these conditions, the electron beam is then modulated in intensity with a video signal to be stored on the target surface, the modulated beam being caused to sweep across the target face so that the surface potential of the insulative regions 12 is reduced to a level in a range from 0 to 12 volts depending on the intensity of the modulation. The conductive layer 11 is then reduced to a potential of +14 volts and as a result of which the surface potential of the insulative regions 12 is caused to reduce to a level in a range between 0 to −12 volts. This potential distribution across the surface of the target represents the electron image.

During subsequent reading operations an unmodulated electron beam is scanned across the target. As it impinges on the target surface, the electron beam that impinges on the insulating regions tends to divert by the action of the negative surface charges on the insulative regions and impinges on the exposed resistive regions. The amount of electrons entering the resistive regions is in inverse proportion to the amount of negative charges on the adjacent insulative regions that constitute an elemental region, or picture element. Therefore, capacitors 23 are charged up in inverse proportion to the charges stored on capacitors 27. It is understood that the resistive regions 13 have the effect of temporal storage of charges to be transferred to the underlying conductive layer 11 as well as the effect of isolating the underlying layer from the direct bombardment of electrons, which prevents the latter from being excessively charged. The storage time or time constant of each picture element defined by a resistive region and its adjacent insulative regions is determined by the resistivity and the thickness of the resistive layer 13. This time constant must be greater than the time it takes for the electron beam to traverse a single picture element, i.e. to read out an elemental electron image stored on the picture element during reading operation. A typical value of this time interval is 100 nanoseconds.

Figure 1:
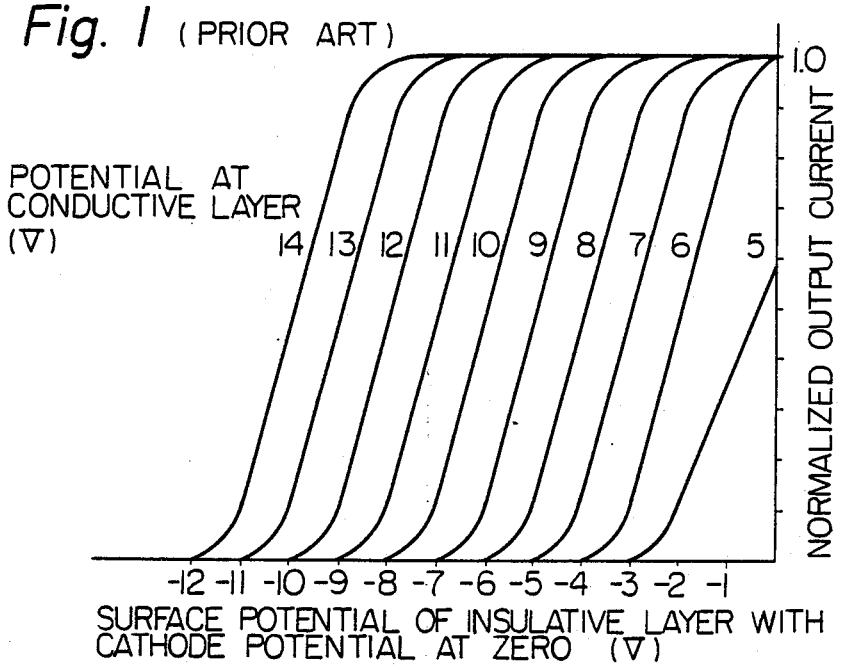
Fig. 1 (PRIOR ART)
FIG. 1 is a graphic illustration of the operating characteristics of the prior art charge storage target.
Figure 7:
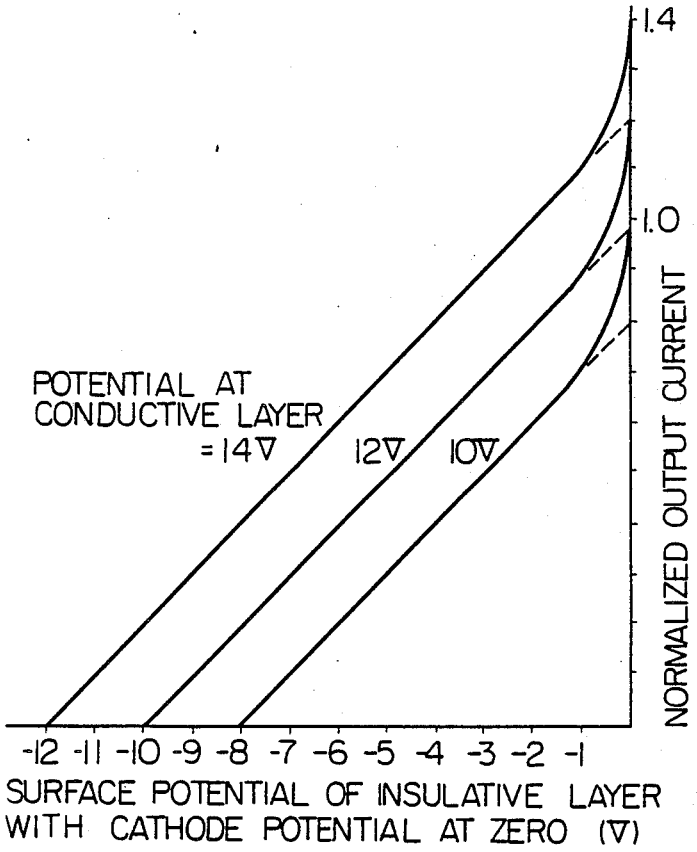
FIG. 7 is a graphic illustration of the operating characteristics of the target according to the invention.

For purposes of discussion, assume that the insulative region of a given picture element has a charge potential of −5 volts and the conductive layer 11 is biased at +14 volts, the capacitor 23 will be continued to be charged until the corresponding terminal 28 is reduced to a voltage level of +7 volts from the initial voltage level of +14 volts as seen from the operating characteristics of FIG. 7. Therefore, a voltage variation of 7 volts is developed across the capacitor 23 and delivered from the conductive layer 11 represented by conductor 21 in FIG. 6. As illustrated in FIG. 7, the video output has a linear range of 11 volts which is 5.5 times the value available with the prior art target structure represented in FIG. 1. Otherwise stated, gradation is improved by the factor of 5.5 as compared with the prior art target.

To permit repeated operations of reading, it is necessary that the capacitors 23 be discharged through resistors 22 before the target is again scanned in the subsequent reading operation. Therefore, the time constant value previously referred to should be smaller than the interval between successive scannings, which is typically 33 milliseconds. Therefore, it is appreciated that the time constant value of the picture element should be greater than the time interval required for the electron beam to traverse the picture element and smaller than the time interval between successive reading operations.

In practical embodiment, the desired time constant value can be obtained by selecting the resistivity of the resistive layer 13 in a range from about $10^5$ to $10^{12}$ ohm-cm and the thickness thereof being in a range from about 1 to 100 micrometers, and preferably in the neighborhood of 20 micrometers. The resistivity of the insulative regions 12 is preferably greater than $10^{14}$ ohm-cm and its thickness ranges from 0.1 to 10 micrometers, of which the preferred value being in a range from 1 to 3 micrometers. The capacitance value of the insulative regions 12 is preferably five times that of the resistive layer 13.

Figure 8:
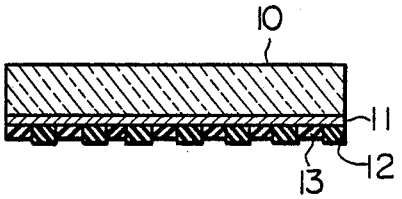
FIGS. 8 to 10 are illustrations of the modifications of the present invention.
Figure 9:
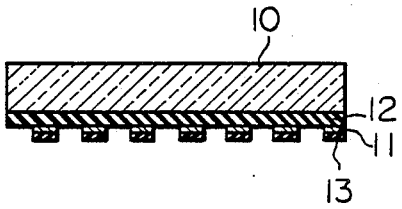
Figure 10:
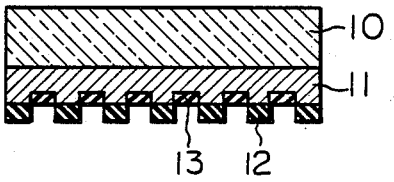

FIGS. 8–10 illustrate alternative embodiments of the invention. In FIG. 8, the insulative regions 12 and the resistive regions 13 are juxtaposed on the conductive layer 11 to form a general surface toward the electron beam source that entirely covers the conductive layer to prevent direct impingement of electrons. In FIG. 9 the insulative layer 12 is in contact with the faceplate 10 and the conductive layer 11 takes the form of a meshed structure which is mounted on the insulative layer 12. The resistive layer 13 is provided on the meshed electrode 11. The conductive layer 11 may be formed of a semiconductive material which is provided with a plurality of etched areas to accommodate the resistive regions as illustrated in FIG. 10. The insulative regions 12 are provided on the areas not occupied by the resistive regions.

Figure 11:
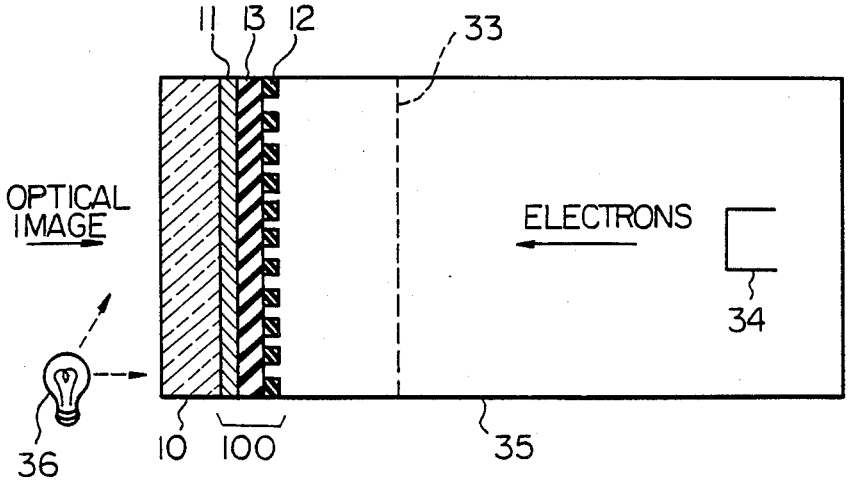
FIG. 11 is a schematic illustration of an image pickup and storage tube according to another aspect of the invention incorporating the charge storage target of the invention.

Image pickup and storage functions can be achieved by forming the resistive layer 13 with a photoconductive material previously described and forming the conductive layer 11 with a transparent conductive material such as $SnO_2$. In FIG. 11, the target structure 100 formed of such compositions is illustrated to operate on dual functions. Incident optical image on the target face 10 is photoelectrically converted by means of the photoconductive properties of the resistive layer 13 into a corresponding electron image which causes the insulative regions 12 to acquire a potential which is 5 to 20 volts lower than the potential at the conductive layer 11. A source of flood light 36 is provided outside of an evacuated envelope 35 in which the target 100, an accelerating mesh electrode 33 and a source of electron beam 34 are arranged in this order. With the electron image so formed on the insulative regions, the photoconductive layer 13 is uniformly illuminated with flood light from the energized light source 36 and simultaneously the conductive layer 11 is brought to +10 volts with respect to the beam source 34 and the mesh electrode 33 to a potential of +300 volts. With these potential relationship, the target surface is scanned with an electron beam of uniform intensity. Since the resistance of the photoconductive layer 13 is reduced by the flooding light, the surface potential of the insulative regions is driven negatively with respect to the beam source, the impinging electron beam enters the photoconductive layer 13 in inverse proportion to the amount of charges stored on the insulative regions in a similar manner to that described previously in connection with FIG. 2.

In practical embodiment, the insulative regions are formed of a material such as $CaF_2$, $MgF_2$, $S_iO_2$, and the photoconductive layer 13 is formed of a material such as $Sb_2O_3$, PbO, CdS, $As_2S_3$, PbS, ZnSe.

What is claimed is:

1. A target structure for an electron storage tube operable on a potential lower than the potential which produces electron-bombardment-induced conductivity to store an electron image in response to an intensity-modulated electron beam and repeatedly read out the stored electron image in response to a periodic impingement of an unmodulated electron beam, comprising an electrically conductive layer, a resistive layer disposed on said conductive layer, and a plurality of insulative regions having a resistivity greater than the 14th power of 10 ohm cm. for storage of said electron image and disposed on said resistive layer, said resistive layer having a resistivity in a range between the 5th power of 10 ohm-cm. and the 12th power of 10 ohm cm. which remains unchanged in the presence of said impingement of the electron beam accelerated by the regions in the direction of the electron beam being in a range between 1 micrometer and 100 micrometers.

2. A target structure as claimed in claim 1, wherein the dielectric constant of said insulative regions is at least five times greater than the dielectric constant of said resistive layer.

3. A target structure as claimed in claim 1, wherein said insulative regions are formed of a substance selected from metal oxides, alkali-halides, alkaline earth metal halides and glass.

4. A target structure as claimed in claim 1, wherein said insulative regions are formed of a substance selected from S102, A1203, CAF2 and MgF2.

* * * * *